US012011649B2

(12) United States Patent
Carleo et al.

(10) Patent No.: US 12,011,649 B2
(45) Date of Patent: Jun. 18, 2024

(54) MODULAR TRANSPORTABLE EXERCISE APPARATUS AND METHODS

(71) Applicant: Hydrow, Inc., Cambridge, MA (US)

(72) Inventors: Joseph Carleo, Boston, MA (US); Adam Craft, Mansfield, MA (US); Emily Hart, Watertown, MA (US); Bruce Smith, Cambridge, MA (US); Christopher Evans, Amherst, NH (US); Mark Matthews, Scituate, MA (US); Peter McNulty, Seattle, WA (US); Jonathan Wenderoth, Stonington, CT (US)

(73) Assignee: Hydrow, Inc., Cambridge, MA (US)

( * ) Notice: Subject to any disclaimer, the term of this patent is extended or adjusted under 35 U.S.C. 154(b) by 217 days.

(21) Appl. No.: 17/743,157

(22) Filed: May 12, 2022

(65) Prior Publication Data

US 2023/0364485 A1 Nov. 16, 2023

(51) Int. Cl.
*A63B 71/00* (2006.01)
*A63B 22/00* (2006.01)

(52) U.S. Cl.
CPC ..... *A63B 71/0036* (2013.01); *A63B 22/0076* (2013.01); *A63B 2210/50* (2013.01)

(58) Field of Classification Search
CPC ..... A63B 22/0076; A63B 22/0087; A63B 2210/50; A63B 71/0036
See application file for complete search history.

(56) References Cited

U.S. PATENT DOCUMENTS

| | | | | |
|---|---|---|---|---|
| 2,291,727 | A | 8/1942 | Kelsey | |
| 9,750,972 | B1 * | 9/2017 | Liu | A63B 22/20 |
| 10,449,409 | B2 * | 10/2019 | Hamilton | A63B 21/0051 |
| 10,471,297 | B1 * | 11/2019 | Smith | A63B 22/0087 |
| 2006/0172862 | A1 | 8/2006 | Badarneh et al. | |
| 2010/0222192 | A1 | 9/2010 | Harris | |
| 2011/0251028 | A1 | 10/2011 | Bono | |
| 2017/0144735 | A1 | 5/2017 | Sciarra | |
| 2017/0291056 | A1 * | 10/2017 | Hsu | A63B 21/0442 |
| 2018/0126216 | A1 * | 5/2018 | Hamilton | A63B 21/151 |
| 2021/0077850 | A1 | 3/2021 | Baker et al. | |
| 2022/0040527 | A1 * | 2/2022 | Chang | A63B 22/0076 |

OTHER PUBLICATIONS

PCT International Search Report and Written Opinion for PCT Application No. PCT/US2023/021442 dated Jul. 21, 2023.

* cited by examiner

*Primary Examiner* — Zachary T Moore
(74) *Attorney, Agent, or Firm* — Duane Morris LLP

(57) ABSTRACT

A modular transportable exercise apparatus includes a first support member having a first hollow tubular plastic frame at least partially embedded with a support material and a second support member having a second hollow tubular plastic frame at least partially embedded with the support material. A connector including a pivoting joint may be arranged to connect a first end of the first support member to a first end of the second support member, including a first portion engaged with the first end of the first support member and a second portion engaged with the first end of the second support member, the first portion being detachably connectable to the second portion.

14 Claims, 9 Drawing Sheets

MODULAR TRANSPORTABLE EXERCISE APPARATUS AND METHODS

TECHNICAL FIELD

This application relates generally to exercise equipment and, more particularly, to techniques for transporting and assembling exercise equipment.

BACKGROUND

Exercise equipment typically includes a large apparatus designed for use in a variety of commercial and non-commercial settings. Because such equipment is exposed to repeated stress during use, components such as the frame typically consist of high strength metal material, which is often relatively heavy and difficult to transport or maneuver by a user. Existing exercise equipment can also be bulky and have awkward form-factors that make transport and handling extremely difficult.

Accordingly, there is a need for lighter, yet equally strong, and more easily transportable exercise equipment that can be more efficiently handled by users.

SUMMARY

The application, in various implementations, addresses deficiencies associated with constructing, transporting, and assembling exercise equipment. The application includes an exemplary apparatus and methods that provide exercise equipment with relatively light, yet high strength, frame components that can be transported in a more efficient and less costly modular manner.

This application describes exemplary apparatuses and methods that include a modular transportable exercise apparatus. The exercise apparatus can be readily transported to a user's chosen setting due to its lightweight build, while providing stable and anticipated performance standards during usage.

In one aspect, a modular transportable exercise apparatus is disclosed. The exercise apparatus may include a first support member having a first hollow tubular plastic frame at least partially embedded with a support material. The exercise apparatus may further include a second support member having a second hollow tubular plastic frame at least partially embedded with the support material. A connector may be arranged to connect a first end of the first support member to a first end of the second support member. The connector may include a pivoting joint having a first portion engaged with the first support member and a second portion engaged with the second support member such that the first portion is detachably connectable to the second portion. In one implementation, a hollow tubular plastic frame includes a cored out and molded frame. In another implementation, a hollow tubular plastic frame includes an extruded and closed tubular frame. In some implementations, one or more plastic frame components may include plastic without an embedded support material, such as, for example, when such plastic provides sufficient support strength. Components of the exercise apparatus other than support members may include plastic that may or may not include embedded support material.

In one implementation, the first portion and/or the second portion of the pivoting joint are permanently or semi-permanently connected to the first support member and the second support member respectively. Permanently connected means that a portion cannot be removed without damaging the exercise apparatus. Semi-permanently means that a portion is not normally removed, but can be without damaging the exercise apparatus. The first portion and/or the second portion may be integrally positioned and/or formed within a portion of the first support member or the second support member respectively.

In one implementation, the plastic frame of the exercise apparatus includes a polycarbonate, polypropylene, polymer, polyvinyl chloride (PVC), acrylonitrile butadience styrene (ABS), nylon, and/or acrylic. The support and/or embedded material for the frame of the exercise apparatus may include, glass, glass beads, glass fiber, mineral fiber, plexiglass, acrylic, rubber, a polymer, polytetrafluoroethylene (PTFE), composite material, bioresin, vinyl, and/or polyvinyl chloride (PVC). In some implementations, at least one plastic frame includes a glass-filled polycarbonate and/or polypropylene. The plastic frame and support materials may be combined in various ratios. The metal of the exercise apparatus and/or the pivoting joint may include aluminum, steel, and/or a composite material. According to another implementation, a cross-section of the first and/or second support member is substantially circular, triangular, rectangular, oval, hexagonal, or multi-sided.

In one implementation, the second portion of the pivoting pin includes a pin holder and/or receiver arranged to receive a pin such that the pin engages the pin receiver on the second portion. The first portion may be arranged to pivot about the pin when the pin is engaged with the pin receiver.

According to another aspect, the disclosure includes a method for manufacturing an exercise apparatus. This method includes providing a first support member having a first hollow tubular plastic frame and at least partially embedding the first support member with a support material. The method also includes providing a second support member having a second hollow tubular plastic frame and at least partially embedding the second support member with the support material. The method includes providing a connector including a pivoting joint arranged to connect a first end of the first support member to a first end of the second support member. The method further includes connecting a first portion of the pivoting joint to the first support member and connecting a second portion of the pivoting joint to the second support member, with the first portion being detachably connectable to the second portion.

In one implementation of the method, the first portion and/or the second portion of the pivoting joint are permanently or semi-permanently connected to the first support member or the second support member respectively. The first portion and/or the second portion may be integrally positioned and/or formed within a portion of the first support member or the second support member respectively.

In one implementation of the method, the plastic frame of the exercise apparatus includes a polycarbonate, polypropylene, polymer, polyvinyl chloride (PVC), acrylonitrile butadience styrene (ABS), nylon, and/or acrylic. According to another implementation of the method, the support and/or embedded material for the frame of the exercise apparatus includes, glass, glass beads, glass fiber, mineral fiber, plexiglass, acrylic, rubber, a polymer, polytetrafluoroethylene (PTFE), composite material, bioresin, vinyl, and/or polyvinyl chloride (PVC). According to one implementation, at least one plastic frame of the exercise apparatus includes a glass-filled polycarbonate and/or polypropylene. According to another implementation of the method, the metal of the pivoting joint includes aluminum, steel, and/or a composite material. The cross-section of the first and/or second support members may be substantially circular, triangular, rectangular, oval, hexagonal, or multi-sided.

In one implementation of the method, the second portion of the pivoting joint includes a pin holder and/or receiver arranged to receive a pin such that the pin engages the pin receiver on the second portion. The first portion and/or first support member may be arranged to pivot about the pin when the pin is engaged with the pin receiver.

In a further aspect, the disclosure includes a multiply housed exercise apparatus transportation kit. The kit includes a first housing containing a first group 402 of components of the exercise apparatus, and at least a second housing containing a second group of components of the exercise apparatus. A third housing or more housings containing a third or additional groups of components of the exercise apparatus may be included, depending on the number of groups of components that may be transported. The first, second, and/or third housing may be less than or equal to 165 inches in length plus girth. The first, second, and/or third housing may be less than or equal to 108 inches in length. According to one implementation, each of the first, second, and third group in the kit weighs less than or equal to 150 pounds.

Any two or more of the features described in this specification, including in this summary section, may be combined to form implementations not specifically described in this specification.

The details of one or more implementations are set forth in the accompanying drawings and the following description. Other features and advantages will be apparent from the description and drawings, and from the claims.

DESCRIPTION OF THE DRAWINGS

Like reference numerals in different figures indicate like elements.

DETAILED DESCRIPTION

The application, in various implementations, addresses deficiencies associated with storing existing exercise equipment. The application includes exemplary apparatuses and methods that enable more efficient, reliable, and less obtrusive construction, assembly, transportation, and storage of exercise equipment.

Figure 1:
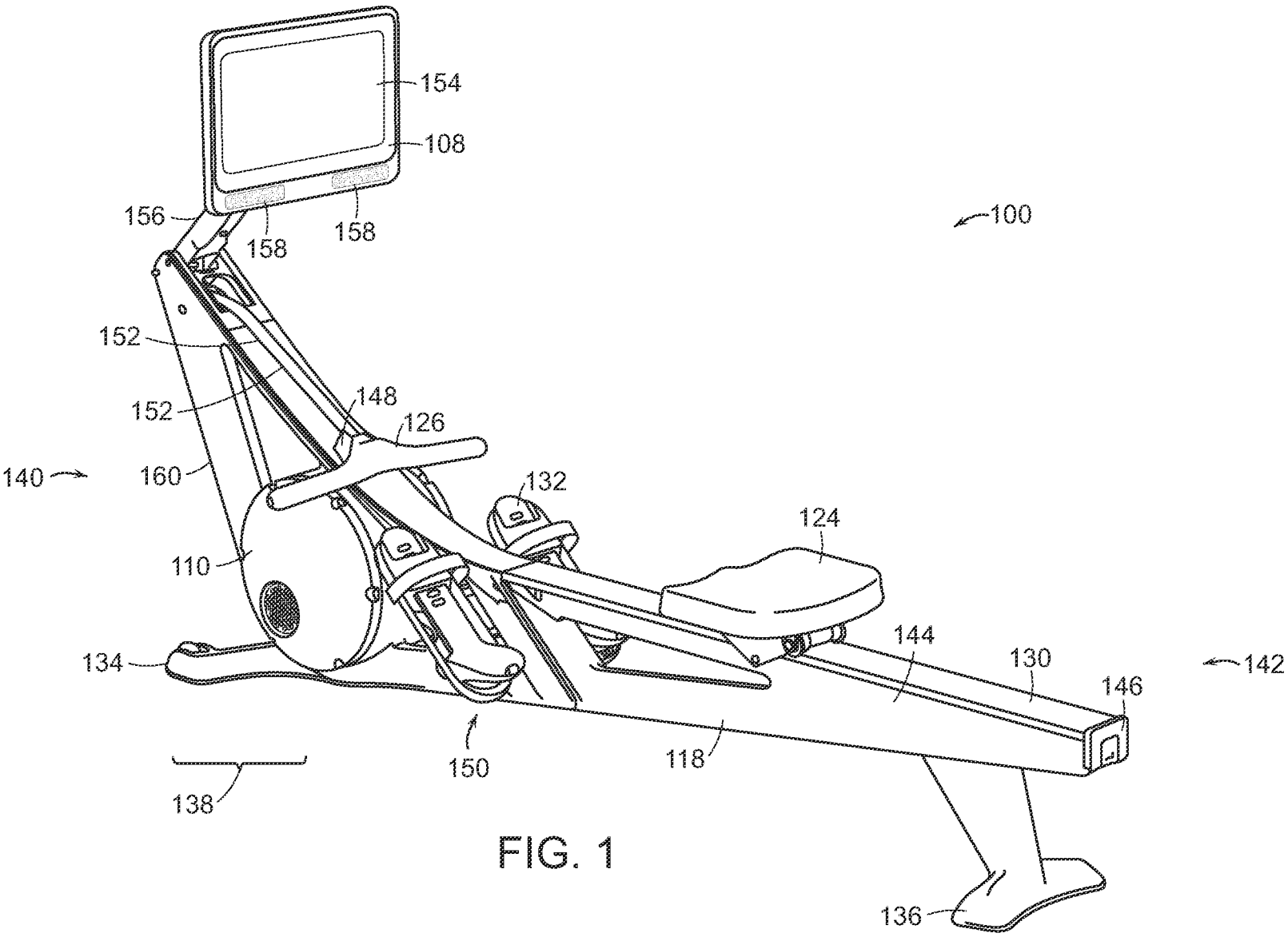
FIG. 1 shows a perspective view of an exercise apparatus including modular frame components.

FIG. 1 shows a perspective view 100 of an exercise apparatus 150 including modular frame components. According to one implementation, exercise apparatus 150 has dimensions of L×W×H: 80"×19"×43" (204 cm×49 cm×110 cm). According to this illustrative example, dimensions when exercise apparatus 150 is in an upright storage orientation is L×W×H: 26.5"×30"×82" (67 cm×76 cm×209 cm). In such implementations, the upright storage system may be used to stabilize the exercise apparatus 150 for vertical storage.

According to one implementation, view 100 shows exercise apparatus 150, e.g., a rowing machine, with frame 118 and seat 124 disposed on track 130. Frame 118 may include end cap 146. According to an illustrative example, seat 124 includes an ergonomically designed cushion with a 2-roller and 2-idler system for smooth operation and easy maintenance. Handle 126 can be operatively supported by handle rest 148. Handle strap and/or cable 152 may facilitate user or rower operation of a flywheel in flywheel housing 110 to provide resistance as the handle strap 152 is being pulled by the rower. The rower's feet may be supported by footrests 132, which may be made of plastic, metal, or a combination thereof. According to an illustrative example, handle strap 152 can include high quality polyester webbing for smooth and quiet operation during use of exercise apparatus 150. Strap 152 may include natural and/or engineered fibers. Strap 152 may include woven metals, extruded metals, polymers, organic materials, and/or other engineered fibers. Strap 152 may include nylon, acrylic, polyester, polypropylene, Kevlar, Dyneema®, jute, hemp, linen, and/or cotton. According to another illustrative example, flywheel housing 110 of exercise apparatus 150 provides dynamic and responsive computer-controlled resistance when operated by a user. According to some implementations, controller 102 (not pictured) facilitates control of the drive assembly 112 (not pictured) and exchanges data with touchscreen 154 on monitor 108. Monitor 108 can be mounted on frame 118 via monitor arm 156. In some implementations, controller 102 and/or monitor 108 are connected to a data network via WiFi, Bluetooth, or another wireless interface.

Exercise apparatus 150 may include and/or receive power from a power source that provides, for example, 100-240 VAC, 50-60 Hz, Power (Peak): 190 W, Power (Avg): 27 W, Power (Idle): 1.1 W of power.. Exercise apparatus 150 may be supported by front foot 134 and rear foot 136 against surface 138. In some implementations, front foot 134 includes one or more wheels to facilitate rolling and subsequent movement of exercise apparatus 150. In an illustrative example, front foot 134 and rear foot 136 include aluminum. In some implementations, display 108 has an audio-visual user interface facilitated by touchscreen 154 and speakers 158. According to an illustrative example, speakers 158 are front-facing to provide a user interface to a user while operating the exercise apparatus 150. Touchscreen 154 may have a resolution of 1920×1080 pixels Full high definition (HD), and have a size of 16" (41 cm). Touchscreen 154 may further include a Capacitive Touch Panel (CTP) to enable customizable user interactions during use of exercise apparatus 150.

Figure 2:
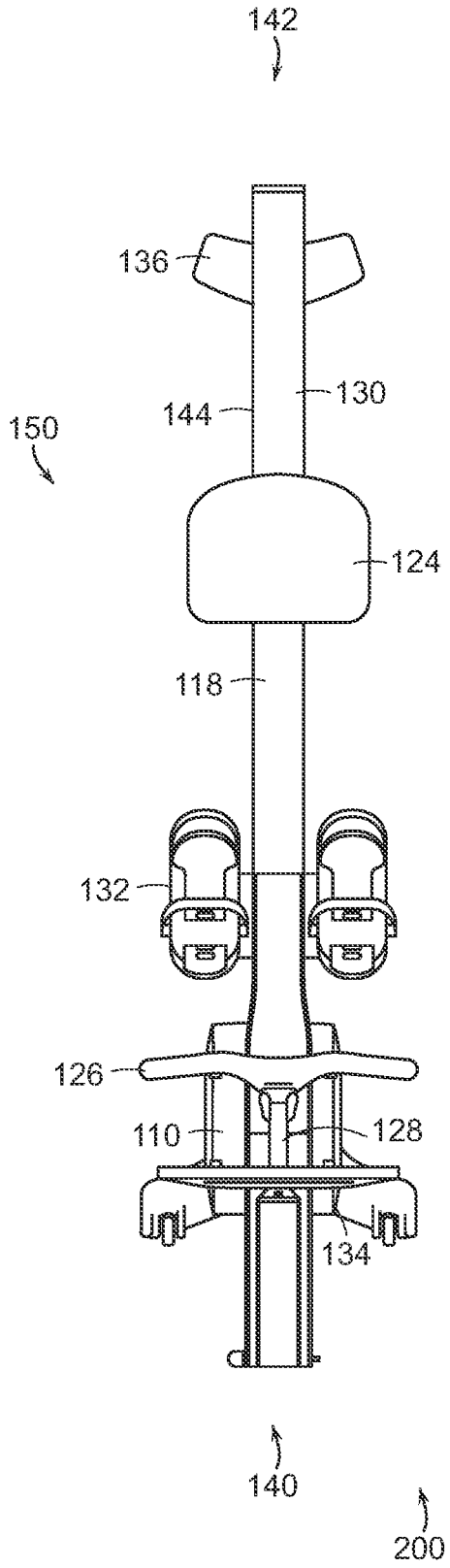
FIG. 2 shows an top down view of the exercise apparatus of FIG. 1.

FIG. 2 shows a top down view 200 of exercise equipment 150. More specifically, in some implementations, the frame 118 supports a track 130. The track 130 can be disposed on a first support member 144 of frame 118 on which seat 124 is mounted to be slidable forward and backward along the track 130. Also shown in FIG. 2, near one end 140 of the frame 118 handle 126 is shown in a retracted position as when the rowing machine is not in use. The handle 126 is connected to a handle strap 152. In an illustrative example, handle 126 is ergonomically designed for a low-stress grip during user operation of exercise apparatus 150. The other end of the handle strap 152 is connected to the flywheel in the flywheel housing 110 that provides resistance against the rower pulling the handle 126 away from its retracted position in the direction toward the opposite end 142 of the frame 118. The flywheel housing 110 may be mounted on the frame 118 near the retracted position of the handle 126. Footrests 132 may be mounted on the frame 118 near the retracted position of the handle 126. The relative position of the footrests 132 and the retracted position of the handle 126 are determined by the body geometry of the rower (and can be adjusted to suit that body geometry) and are configured to enable a rowing motion by the rower during operation. In some examples, footrests 132 may be adjustable to enable preferred foot placement by a user during operation of exercise apparatus 150.

Figure 3:
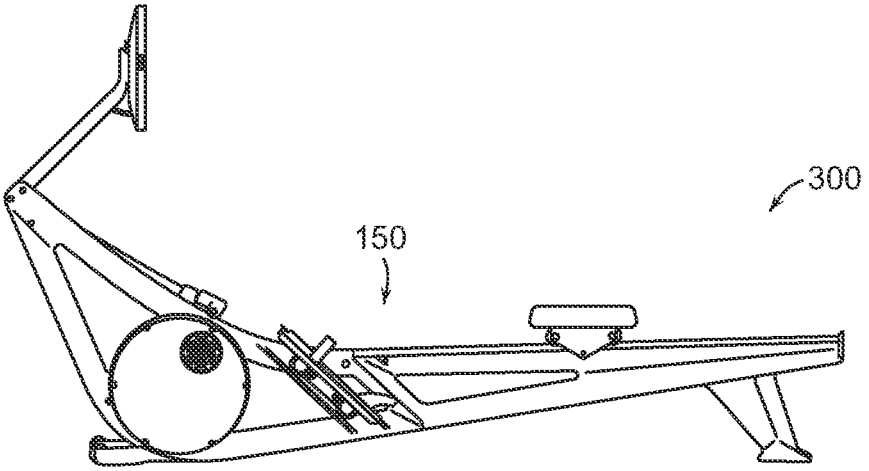
FIG. 3 shows an alternate perspective view of the exercise apparatus of FIG. 1.

FIG. 3 shows an alternate perspective view 300 of exercise apparatus 150.

Figure 4:
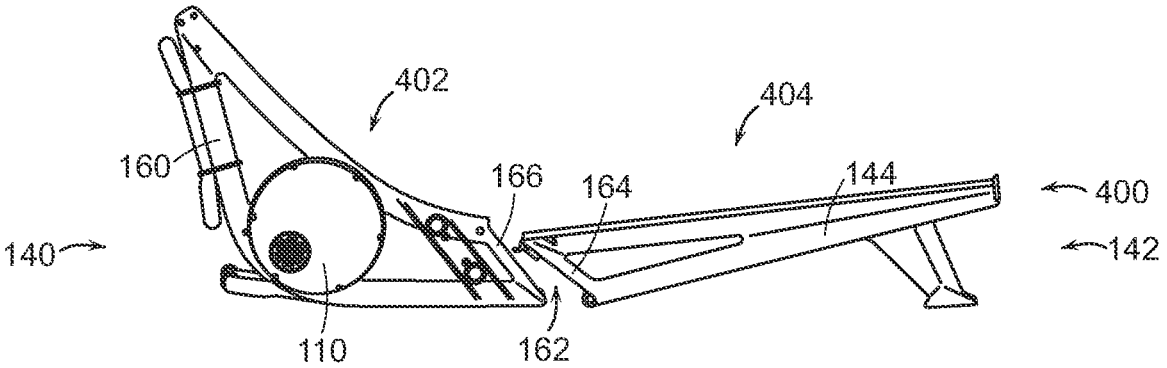
FIG. 4 shows a perspective view of modular transportable exercise apparatus when disconnected.

FIG. 4 shows a perspective view 400 of modular transportable exercise apparatus 150 when certain components are disconnected. Modular transportable exercise apparatus 150 may include first support member 144. According to one implementation, first support member 144 may have a first hollow tubular plastic frame at least partially embedded with a support material. The exercise apparatus 150 may further include a second support member 160. According to one implementation, second support member 160 has a second hollow tubular plastic frame at least partially embedded with the support material. For example, rigid support material for both first support member 144 and second support member 160 may include plastic, glass, and/or other similar lightweight materials. In one implementation, the plastic frame of the exercise apparatus 150 includes a polycarbonate, polypropylene, polymer, polyvinyl chloride (PVC), acrylonitrile butadience styrene (ABS), nylon, and/or acrylic. The support or embedded material for the frame such as frame 118 of the exercise apparatus 150 may include glass, glass beads, glass fiber, mineral fiber, plexiglass, acrylic, rubber, a polymer, polytetrafluoroethylene (PTFE), composite material, bioresin, vinyl, and/or polyvinyl chloride (PVC). According to one implementation, at least one plastic frame 118 of exercise apparatus 150 includes a glass-filled polycarbonate and/or polypropylene. A connector 162 may be arranged to connect a first end 164 of the first support member 144 to a first end 166 of the second support member 160. In some implementations, one or more plastic frame components, e.g., support members 144 and/or 160, may include plastic without an embedded support material, such as, for example, when such plastic provides sufficient support strength. Components of the exercise apparatus 150 other than support members such as support members 144 and 160 may include plastic that may or may not include embedded support material.

Figure 5A:
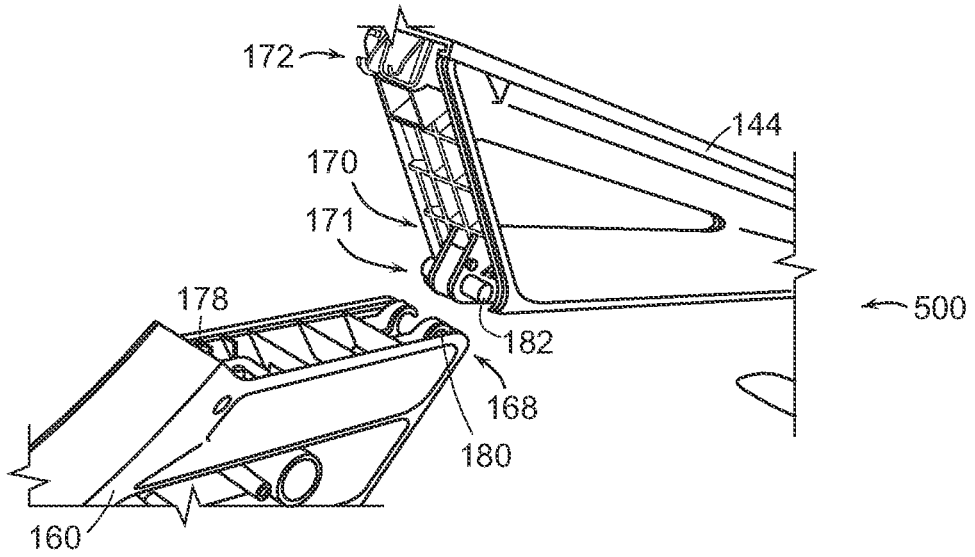
FIGS. 5A and 5B show perspective views of the connecting process of a first support member and a second support member.
Figure 5B:
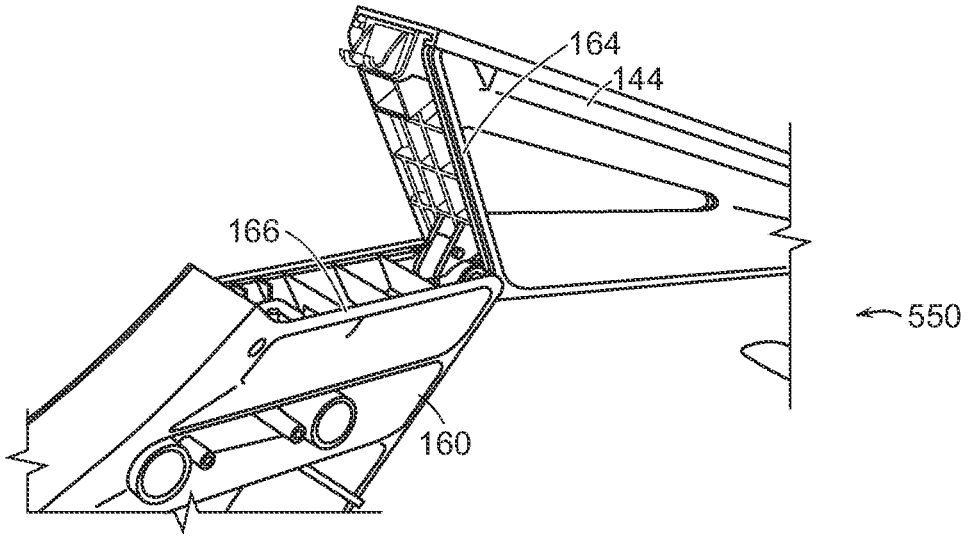

The connector 162 may include a pivoting joint 171 having a first portion 170 engaged with the first support member 144 and a second portion 168 engaged with the second support member 160, as shown in FIG. 5A (when separate) and FIG. 5B (when connected). According to some implementations, the first portion 170 is detachably connectable to the second portion 168. The second portion 168 of the pivoting joint 171 may include a first pin holder and/or pin receiver 180 arranged to receive a pivoting joint pin 182 such that pin 182 engages pin receiver 180 on the second portion 168 of pivoting joint 171. Additionally, the first portion 170 of pivoting joint 171 and/or support member 144 may be arranged to pivot about the pivoting joint pin 182 when pin 182 is engaged with the pin receiver 180. According to another implementation, a cross-section of the first and/or second support members 144 and 160 is substantially circular, triangular, rectangular, oval, hexagonal, or multi-sided. According to some implementations, end 164 of support member 144 includes a locking hook 172 that detachably engages locking hook receiver 178 at a locking joint 702 (shown in the closed position in FIG. 7) using frame bolt 176. The locking joint 702 may be positioned in proximity to the top of support member 144 while being spaced away from pivoting joint 171, which may be positioned proximate to the bottom of support member 144. The locking joint 702 may be arranged to secure the connection at connector 162 of end 164 of support member 144 to end 166 of support member 160 after end 164 of support member 144 has been rotated and/or pivoted about pivoting joint 171 until engagement with end 166 of support member 160 at locking joint 702.

In some implementations, a first group 402 of components 160 and 110 may be housed and transported in a first housing of a kit while a second group 404 of components 144 and 136 may be housed and transported in a second housing of a kit.

FIGS. 5A and 5B show perspective views 500 and 550 of the connecting process of first support member 144 and second support member 160 according to some implementations. For example, to connect first support member 144 and second support member 160, first end 164 of the first support member 144 can be lined up to first end 166 of the second support member 160 with front foot 134 and rear foot 136 facing away from each other. A user can then lift first end 164 of the first support member 144 and first end 166 of the second support member 160 to slide first portion 170 of a pivoting joint 171 up and under second portion 168 of pivoting joint 171 while enabling pin 182 to secure first portion 170 to second portion 168 of pivoting joint 171. In this way, first support member 144 can be lowered and pivoted about pivoting joint 171 until locking hook 172 engages with locking hook receiver 178 in second support member 160. In some implementations, the pivoting joint pin 182 includes a metal. A metal pin 182 may advantageously facilitate a stronger and more reliable connection between first support member 144 and second support member 160. The metal may include aluminum, steel, and/or a composite material. According to some implementations, front foot 134 and rear foot 136 contact the surface 138.

Figure 6A:
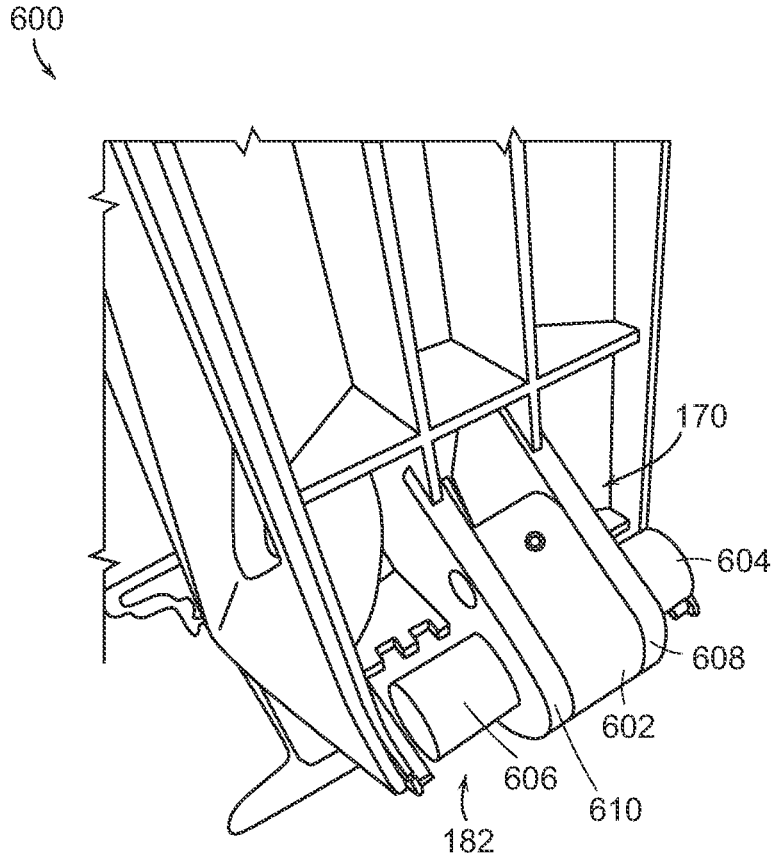
FIG. 6A shows a zoomed in view of the first portion of the pivoting joint including the pivoting joint pin.

FIG. 6A shows a zoomed in view 600 of the first portion 170 of the pivoting joint 171 including pivoting joint pin 182. The first portion 170 may include a bolster 602 arranged to support pin 182 and reduce possible failure of pivoting joint 171 by reducing stress on plastic components of portion 170. In some implementations bolster 602 includes a metal such as steel or aluminum, and/or composite materials. Pin 182 may include outer lateral portions 604 and 606 to enable pin 182 to engage with second portion 168 of pivoting joint 171. The first portion 170 may include support arms 608 and 610 arranged to hold pin 182 with bolster 602 position in between to reinforce support arms 608 and 610 and increase the strength of pivoting joint 171.

Figure 6B:
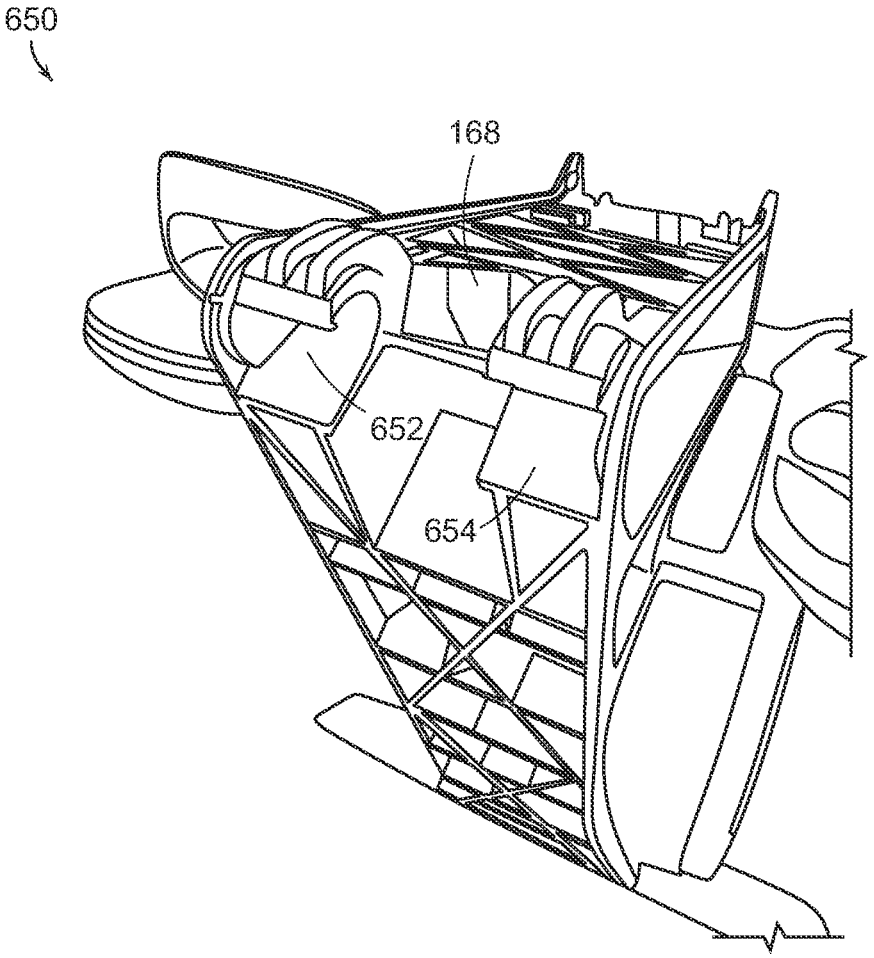
FIG. 6B shows a zoomed in view of the second portion including pin receiver hooks.

FIG. 6B shows a zoomed in view 650 of the second portion 168 including pin receiver hooks 652 and 654 that are spaced apart and arranged to detachably engage with outer lateral portions 604 and 606 of pin 182 to enable first portion 170 and second portion 168 to detachably engage with each other.

Figure 7:
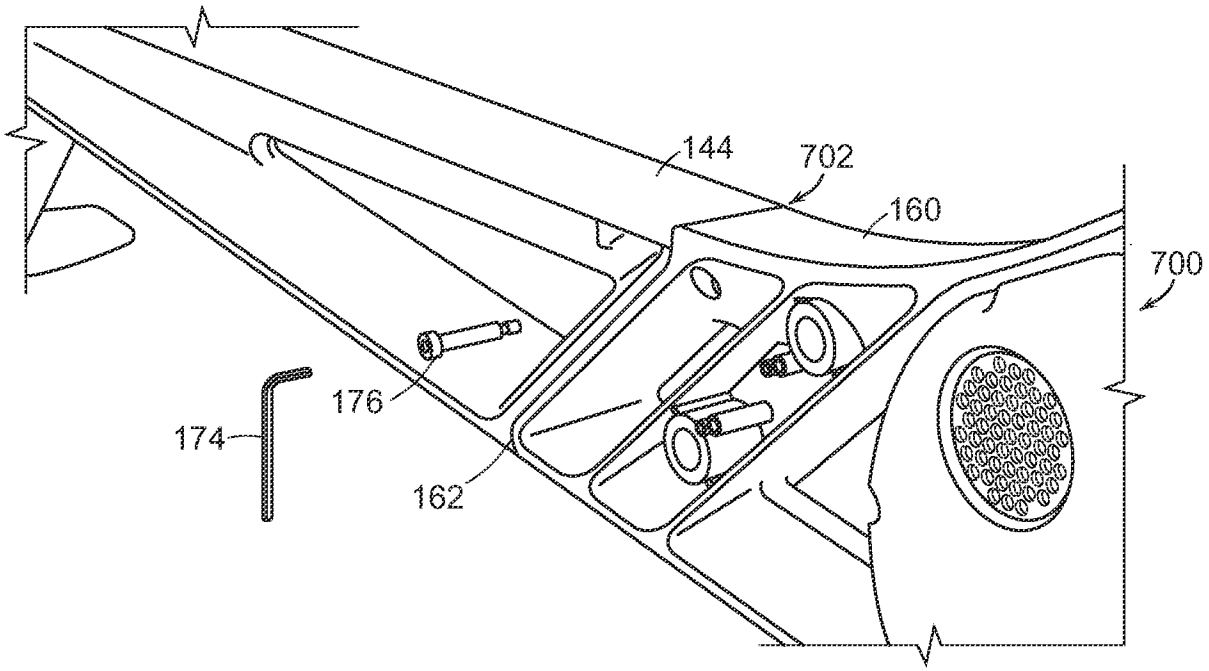
FIG. 7 shows a perspective view of the first support member and the second support member of FIG. 6 being further secured.

FIG. 7 shows a view 700 of connector 162 in the closed position, according to one implementation, including a hex key 174 that can be used to secure first support member 144 to second support member 160 with the frame bolt 176 at locking joint 702. In some implementations, the first portion 170 and/or the second portion 168 are integrally positioned and/or formed within a portion of the first support member 144 or the second support member 160 respectively.

Figure 8:
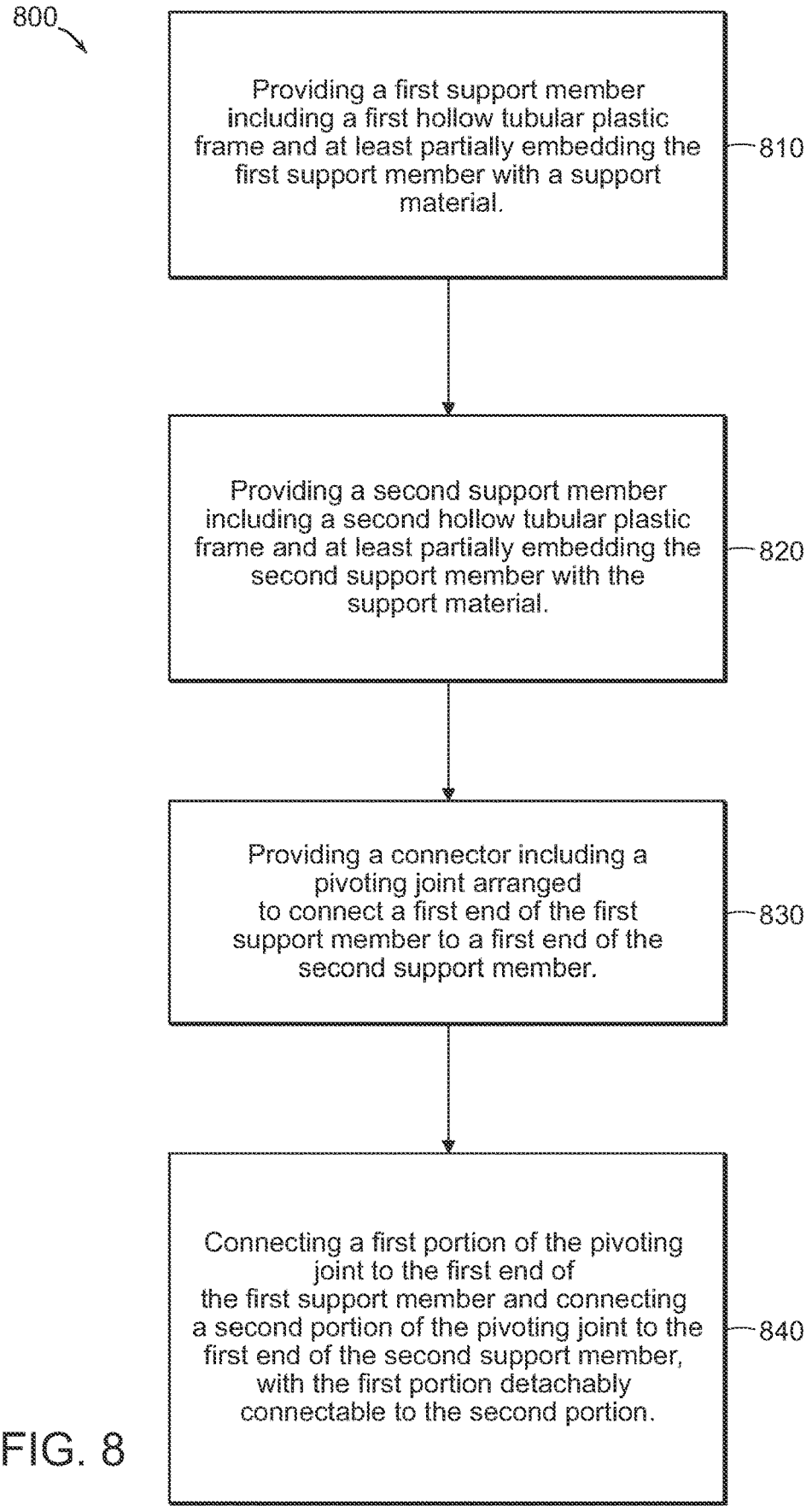
FIG. 8 shows a method 800 for manufacturing an exercise apparatus.

FIG. 8 shows a method 800 for manufacturing an exercise apparatus 150. This method includes providing a first support member 144 including a first hollow tubular plastic frame and at least partially embedding the first support member 144 with a support material (Step 810). The method further includes providing a second support member 160 including a second hollow tubular plastic frame and at least partially embedding the second support member 160 with the support material (Step 820). The method further includes providing a connector 162 including a pivoting joint 171 arranged to connect a first end 164 of the first support member 144 to a first end166 of the second support member 160(Step 830). The method includes connecting a first portion 170 of pivoting joint 171 to the first support member 144 and connecting a second portion 168 of the pivoting joint 171 to the second support member 160, with the first portion 170 being detachably connectable to the second portion 168(Step 840).

In one implementation of the method 800, at least one of the first portion 170 and the second portion 168 of the pivoting joint 171 are permanently or semi-permanently connected to the first support member 144 and the second support member 160 respectively. The first portion 170 and/or the second portion 168 may be integrally formed and/or positioned within a portion of the first support member 144 or the second support member 160 respectively.

In some implementations of the method 800, the plastic frame of the exercise apparatus 150 includes a polycarbonate, polypropylene, polymer, polyvinyl chloride (PVC), acrylonitrile butadience styrene (ABS), nylon, and/or acrylic. The support or embedded material of the exercise apparatus 150 includes glass, glass beads, glass fiber, mineral fiber, plexiglass, acrylic, rubber, a polymer, polytetrafluoroethylene (PTFE), composite material, bioresin, vinyl, and/or polyvinyl chloride (PVC). According to one implementation, at least one frame of exercise apparatus 150 includes a glass-filled polycarbonate and/or polypropylene. According to another implementation of the method 800, the metal of the exercise apparatus 150 includes aluminum, steel, and/or a composite material. According to another implementation of the method 800, a cross-section of at least one of the first and second support members 144 and 160 is substantially circular, triangular, rectangular, oval, hexagonal, and/or multi-sided. According to another implementation of the method 800, the first portion 170 of the exercise apparatus 150 includes a locking hook 172 that detachably engages a locking hook receiver 178 in the second portion 168 at a locking joint 702 using a frame bolt 176. In some implementations of the method 800, the second portion 168 of pivoting joint 171 includes pin holder and/or receiver 180 arranged to receive a pivoting joint pin 182 such that pin 182 engages pin receiver 180 on second portion 168. Additionally, the first portion 170 and/or support member 144 may be arranged to pivot about pin 182 when pin 182 is engaged with pin receiver 180.

Figure 9:
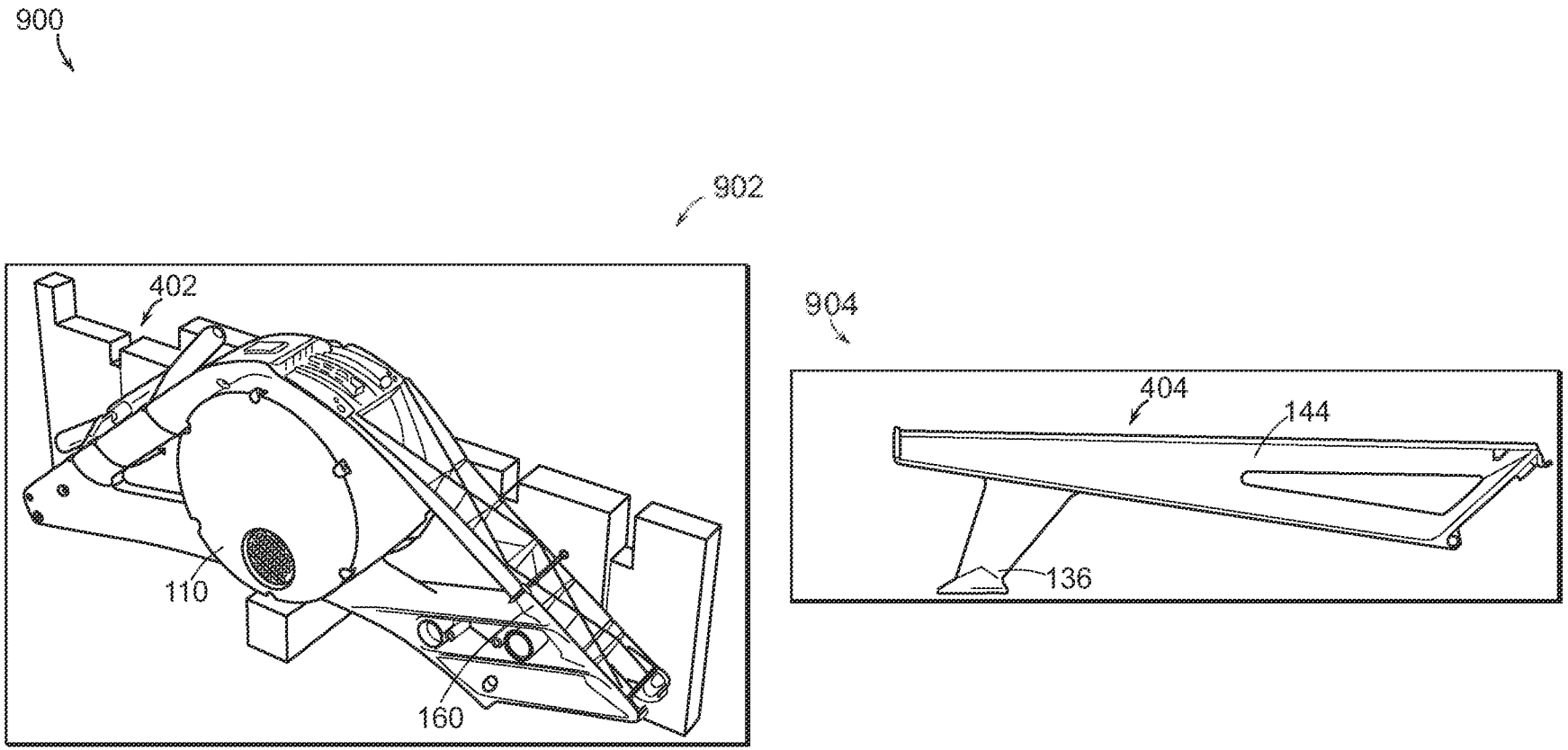
FIG. 9 shows a multiply housed exercise apparatus transportation kit.

FIG. 9 shows a multiply housed exercise apparatus transportation kit 900. The kit 900 may include a first housing or package 902 containing a first group 402 of components 110 and 160 of the exercise apparatus 150 and at least a second housing or package 904 containing a second group 404 of components 136 and 144 of the exercise apparatus 150. A third housing or more housings containing a third or additional groups of components of the exercise apparatus 150 may be included, depending on the number of groups of components that may be transported. The first, second, and/or third housing (if included) may be less than or equal to 165 inches in length plus girth. The first, second, and/or third housing (if included) may be less than or equal to 108 inches in length. According to one implementation, each of the first, second, and third group in the kit weighs less than or equal to 150 pounds. Each of the housings or packages may include cardboard, plastic, metal, wood, or any combination thereof.

Elements or steps of different implementations described may be combined to form other implementations not specifically set forth previously. Elements or steps may be left out of the systems or processes described previously without adversely affecting their operation or the operation of the system in general. Furthermore, various separate elements or steps may be combined into one or more individual elements or steps to perform the functions described in this specification.

Other implementations not specifically described in this specification are also within the scope of the following claims.

What is claimed is:

1. A modular transportable exercise apparatus comprising:

a first support member including a first hollow tubular plastic frame at least partially embedded with a support material;

a second support member including a second hollow tubular plastic frame at least partially embedded with the support material;

a connector including a pivoting joint arranged to connect a first end of the first support member to a first end of the second support member;

wherein the pivoting joint includes a first portion engaged with the first end of the first support member and a second portion engaged with the first end of the second support member, the first portion being detachably connectable to the second portion;

wherein the first portion includes a pin and the second portion includes a pin receiver, the pin being detachably connectable to the pin receiver;

wherein the pin receiver includes at least one hook, the pin being detachably connectable to the at least one hook; and wherein the at least one hook includes two hooks spaced apart and arranged to detachably engage with outer lateral portions of the pin.

2. The exercise apparatus of claim 1, wherein at least one of the first portion and the second portion are integrally formed within a portion of the first support member and the second support member respectively.

3. The exercise apparatus of claim 1, wherein the plastic includes at least one of a polycarbonate, polypropylene, polymer, polyvinyl chloride (PVC), acrylonitrile butadience styrene (ABS), nylon, and acrylic.

4. The mounting apparatus of claim 1, wherein the support material includes at least one of, glass, glass beads, glass fiber, mineral fiber, plexiglass, acrylic, rubber, a polymer, polytetrafluoroethylene (PTFE), composite material, bioresin, vinyl, and polyvinyl chloride (PVC).

5. The mounting apparatus of claim 1, wherein the pin includes a metal, the metal including at least one of aluminum, steel, and a composite material.

6. The exercise apparatus of claim 5, wherein the first portion includes a metal bolster arranged to support the pin.

7. The mounting apparatus of claim 1, wherein the connector further includes a locking joint spaced away from the pivoting joint, the locking joint arranged to secure the connection of the first end of the first support member to the first end of the second support member after the first end of the first support member has been rotated about the pivoting joint until engagement with the first end of the second support member at the locking joint.

8. A method for manufacturing an exercise apparatus comprising:

providing a first support member including a first hollow tubular plastic frame;

at least partially embedding the first support member with a support material;

providing a second support member including a second hollow tubular plastic frame;

at least partially embedding the second support member with the support material;

providing a connector including a pivoting joint arranged to connect a first end of the first support member to a first end of the second support member;

connecting a first portion of a pivoting joint to the first end of the first support member; and connecting a second portion of the pivoting joint to the first end of the second support member;

wherein the first portion is detachably connectable to the second wherein the first portion includes a pin and the second portion includes a pin receiver, the pin being detachably connectable to the pin receiver;

wherein the pin receiver includes at least one hook, the pin being detachably connectable to the at least one hook; and wherein the at least one hook includes two hooks spaced apart and arranged to detachably engage with outer lateral portions of the pin.

9. The method of claim 8, wherein at least one of the first portion and the second portion are integrally formed within a portion of the first support member and the second support member respectively.

10. The method of claim 8, wherein the plastic includes at least one of a polycarbonate, polypropylene, polymer, polyvinyl chloride (PVC), acrylonitrile butadience styrene (ABS), nylon, and acrylic.

11. The method of claim 8, wherein the support material includes at least one of glass, glass beads, glass fiber, mineral fiber, plexiglass, acrylic, rubber, a polymer, polytetrafluoroethylene (PTFE), composite material, bioresin, vinyl, and polyvinyl chloride (PVC).

12. The method of claim 8, wherein the pin includes a metal, the metal including at least one of aluminum, steel, and a composite material.

13. The method of claim 8, wherein the first portion includes a metal bolster arranged to support the pin.

14. The method of claim 8, wherein the connector further includes a locking joint spaced away from the pivoting joint, the locking joint arranged to secure the connection of the first end of the first support member to the first end of the second support member after the first end of the first support member has been rotated about the pivoting joint until engagement with the first end of the second support member at the locking joint.

* * * * *